United States Patent [19]

Hoskinson et al.

[11] 4,271,741

[45] Jun. 9, 1981

[54] ACCOMPANIMENT SYSTEM FOR ELECTRONIC MUSICAL INSTRUMENT

[75] Inventors: William R. Hoskinson, Geneva, Ill.; Peter E. Solender, Williamsville, N.Y.; William V. Machanian, DeKalb, Ill.

[73] Assignee: The Wurlitzer Company, DeKalb, Ill.

[21] Appl. No.: 886,750

[22] Filed: Mar. 15, 1978

[51] Int. Cl.[3] ..... G10F 1/00

[52] U.S. Cl. ..... 84/1.03; 84/DIG. 12; 84/1.24

[58] Field of Search ..... 84/1.03, 1.17, 1.24, 84/1.28, DIG. 22, DIG. 12, 1.01

[56] References Cited

U.S. PATENT DOCUMENTS

| | | | |
|---|---|---|---|
| 3,918,341 | 11/1975 | Bunger | 84/DIG. 22 |
| 3,921,491 | 11/1975 | Freeman | 84/DIG. 22 |
| 3,986,424 | 10/1976 | Sakashita | 84/DIG. 22 |
| 4,000,674 | 1/1977 | Schreier | 84/DIG. 22 |
| 4,010,667 | 3/1977 | Kniepkamp | 84/1.03 |
| 4,059,039 | 11/1977 | Carlson | 84/DIG. 22 |
| 4,072,078 | 2/1978 | Shallenberger et al. | 84/DIG. 22 |
| 4,112,802 | 9/1978 | Robinson et al. | 84/DIG. 22 |
| 4,120,225 | 10/1978 | Dietrich et al. | 84/1.03 |
| 4,127,048 | 11/1978 | Schmoll | 84/1.17 |
| 4,148,241 | 4/1979 | Morez et al. | 84/DIG. 22 |

OTHER PUBLICATIONS

McGraw-Hill, Dictionary of Scientific and Technical Terms, 1976, p. 1228.

*Primary Examiner*—J. V. Truhe
*Assistant Examiner*—Forester W. Isen
*Attorney, Agent, or Firm*—Trexler, Wolters, Bushnell & Fosse, Ltd.

[57] ABSTRACT

An accompaniment system for an electronic musical instrument is selectively actuatable for producing accompaniment effects such as arpeggio in accordance with selectable notes or chords and with selectable rhythm patterns. The electronic musical instrument includes one or more conventional keyboards, a set of chord switches for selecting one of a plurality of predetermined chords and a set of rhythm switches for selecting one of a plurality of predetermined rhythm patterns, respectively. The accompaniment system includes a ROM containing note position signals arranged in a plurality of groups, each group corresponding to one of the selectable rhythm patterns. An electronic circuit selects one of the groups in response to activation of one of the rhythm pattern selector switches and sequentially combines each note position signal in the group with a chord displacement signal developed in response to actuation of one of the keyboard notes or chord selection switches. The electronic circuit then produces electronic signals corresponding to selected notes of the chromatic scale in accordance with the selected note or chord and rhythm pattern. The ROM further contains a note decay characteristic control signal associated with each of the note signals. The accompaniment system also includes another electronic circuit responsive to the electronic note signals and their associated note decay signals for directing the electronic musical instrument to sound notes to produce an accompaniment effect in accordance with the selected note or chord, with the selected rhythm pattern and with the predetermined decay characteristics of each note.

22 Claims, 12 Drawing Figures

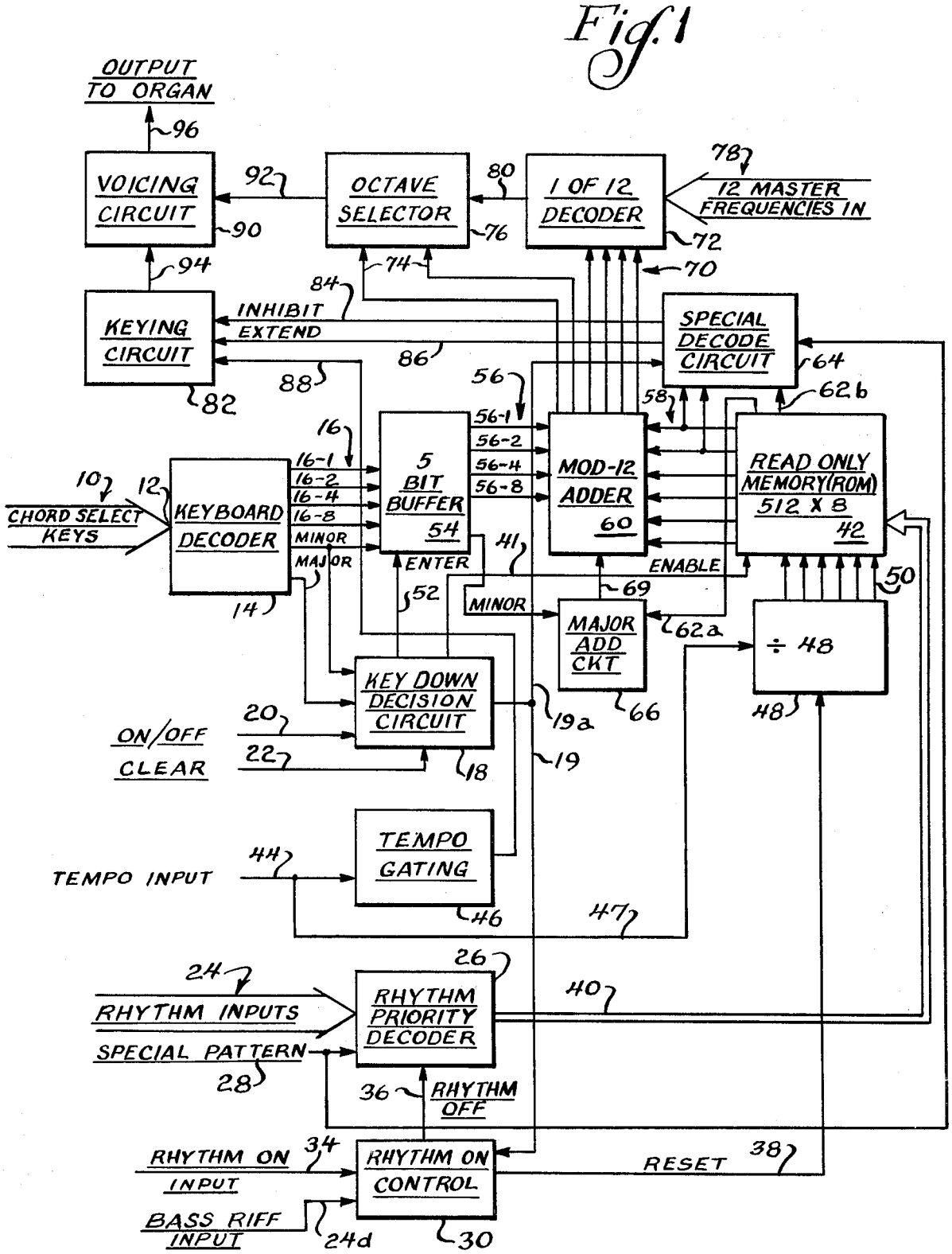
Fig. 1
OUTPUT TO ORGAN
96
VOICING CIRCUIT
90
92
OCTAVE SELECTOR
76
80
1 OF 12 DECODER
72
78
12 MASTER FREQUENCIES IN
94
74
70
84
KEYING CIRCUIT
82
INHIBIT
EXTEND
86
88
SPECIAL DECODE CIRCUIT
64
62b
56
58
16
5 BIT BUFFER 54
56-1
56-2
56-4
56-8
MOD-12 ADDER 60
READ ONLY MEMORY (ROM) 512 X 8 42
10
12
CHORD SELECT KEYS
KEYBOARD DECODER
16-1
16-2
16-4
16-8
MINOR
MAJOR
14
ENTER
41
ENABLE
50
52
MINOR
69
MAJOR ADD CKT
62a
÷ 48
48
KEY DOWN DECISION CIRCUIT
66
19a
19
18
20
22
ON/OFF
CLEAR
TEMPO GATING
46
44
TEMPO INPUT
47
26
24
RHYTHM INPUTS
RHYTHM PRIORITY DECODER
40
SPECIAL PATTERN
28
36
RHYTHM OFF
RHYTHM ON INPUT
34
RHYTHM ON CONTROL
RESET
38
BASS RIFF INPUT
24d
30

60a
4 BIT ADDER
138
144
70-1
70-2
70-4
70-8
+V
142a
142b
142c
16-1
16-2
16-4
16-8
6 BIT BUFFER
54
56-1
56-2
56-4
56-8
MINOR
4 BIT ADDER
136
58-1
58-2
58-4
58-8
69
66
62a
52
MAJOR
110
MINOR
MONOSTABLE
112
114
FF
120
124
118
116
19
FF
122
41
18
47
TEMPO
125
44
126
MONOSTABLE
46
88
ON/OFF
20
272
274
286
276
270
38
292
294
22
CLEAR

F F# G G# A B♭ B C
C# D D# E
78
+V
÷2
154
MPX
146
MPX
148
70-1
70-2
70-4
70-8
÷2
156
58
150
÷2
158
62a
72
80
152
80
÷16
162
76
41
+V
47
162a
162c
162d
162b
60b
74-12
140a
DUAL
1 OF 4
164
+V
88
140c
140b
74-24
166
205
64a
84
19a
64b
168
38
58-12
58-24
92

ROM
42
41
÷16
128
FF
130
FF
132
134
38
48
50
40a
40b
40c
47
58
58-12
58-4
58-2
58-1
58-8
58-24
62a
62b
+V
84
86
88
64c
178
180
182
196
198
192
188
186
190
194
184
200
203
202
204
206
208
210
212
214
216
218
220
222
224
226
228
230
232
234
236
238
240
90
92
94
82

ACCOMPANIMENT SYSTEM FOR ELECTRONIC MUSICAL INSTRUMENT

BACKGROUND OF THE INVENTION

This invention relates generally to the production of accompaniment effects, such as arpeggio effects or bass patterns, in an electronic musical instrument, and more particularly to the production of such effects by an electronic conduit, including a ROM, responsive to the selection of chord and rhythm information for producing arpeggio effects in accordance with such selection.

DESCRIPTION OF THE PRIOR ART

In general, arpeggio and bass effects such as "walking bass" require the playing of consecutive notes, e.g., the notes of a musical chord in a given succession. Usually, the notes of an arpeggio are rapidly played and are repeated through one or more successive octaves. It will be appreciated that considerable skill and dexterity on the part of the musician is required to play such effects directly on the keyboard of an electronic musical instrument such as an electronic organ. Moreover, it is difficult to play such effects in tempo with and in a rhythm complimentary to the rhythm of the melody and other accompaniment being played. Thus, automatic production of such effects in tune, in tempo, and in accordance with the rhythm of the melody and other accompaniment being played permits a relatively unskilled player to make use of such effects in playing.

The prior art contains a number of arrangements intended to provide arpeggio effects in a somewhat simpler fashion than manual playing thereof on a keyboard of the instrument. Initially, such devices as disclosed by U.S. Pat. No. 3,358,070 to Young employed an auxiliary miniature keyboard which could be manually "run across" to play an arpeggio effect comprising only those notes as selected by activating keys on one of the main keyboards of the instrument. This arrangement, however, requires some dexterity in activating the auxiliary keyboard while at the same time playing one or more of the other keyboards of the instrument. Furthermore, these arrangements make no provision for the arpeggio note selection, the player being required to depress the proper notes to make up the desired arpeggio notes on one of the main keyboards of the instrument. Moreover, the player must manually activate the auxiliary or arpeggio keyboard in the proper tempo and rhythm to accompany the music being played.

Other prior art systems have utilized electronic circuits to obviate the need for an auxiliary arpeggio keyboard and thus solve the first problem of playing the auxiliary keyboard while at the same time playing one or more of the other keyboards of the instrument. One such system and some variations thereof are disclosed in the following U.S. Pat. Nos.: 3,718, 748 to Bunger, 3,725,526 to Munch, Jr., et al and 3,842,184 to Bunger. Each of these systems produces an arpeggio effect in response to activation of a foot switch or the like by the player, the arpeggio including selected octavely related tones of notes corresponding to the keys activated by the player on one of the keyboards of the instrument. None of these systems, however, provides for automatically varying the arpeggio effect in accordance with selectable rhythm patterns and with a selectable tempo. Moreover, these systems will require the player to individually select the proper notes of the arpeggio on a keyboard so as to be in tune with the melody and accompaniment being played.

Other prior art systems are disclosed in the following U.S. Pat. Nos.: 3,617,602 to Kniepkamp; 3,832,479 to Aliprandi; 3,842,184 to Kniepkamp; 3,854,366 to Deutsch and 4,059,039 to Carlson. These patents disclose systems similar to the patents cited above in that various electronic circuit arrangements are disclosed for producing arpeggio effects in accordance with several keys manually activated on one of the instrument keyboards. Thus, all of the systems still depend on the skill of the player to select the notes from which the arpeggio effect will be formed in one or more octaves, so that the arpeggio effect will be in tune with the music being played. Further, none of these systems provide for automatically varying the arpeggio effect to sound in accordance with a selectable rhythm pattern and in tempo therewith.

OBJECTS AND SUMMARY OF THE INVENTION

Accordingly, it is a general object of this invention to provide a new and improved accompaniment system for an electronic musical instrument.

A more specific object of this invention is to produce a new and improved accompaniment system responsive to actuation of a single chord or key switch for automatically producing an arpeggio effect including preselected notes in tune with the chord or note selected.

Another object is to provide an accompaniment system in accordance with the foregoing objects which is further variable in response to a selectable tempo and a selectable rhythm pattern to produce the accompaniment effect in a pattern and at a tempo in accordance with the selected rhythm pattern and tempo.

Still another object of this invention is to provide an accompaniment system in accordance with the foregoing objects which is further adapted to produce a predetermined decay characteristic of each note of the accompaniment pattern produced in accordance with the preselected rhythm pattern.

Briefly, and in accordance with the foregoing objects, a preferred embodiment of an accompaniment system for an electronic musical instrument according to this invention comprises an electronic circuit including memory means and responsive to selection of a note or a chord and to selection of a rhythm pattern and tempo on said electronic musical instrument for directing said electronic musical instrument to sound an accompaniment effect comprising preselected notes and predetermined octavely related notes in the key of the selected note or chord in a predetermined sequence, in a predetermined pattern selected from said memory means in accordance with the selected rhythm pattern, and in tempo with the selected tempo.

Other objects, features and advantages of this invention will be appreciated upon consideration of the following detailed description together with the accompanying drawings, wherein like reference numerals are used to designate like elements and components.

BRIEF DESCRIPTION OF THE DRAWINGS

FIG. 1 is a circuit schematic, in block diagrammatic form of an accompaniment system in accordance with this invention, embodied as an arpeggio system.

FIG. 3 is an illustration of the manner in which FIGS. 2A–2E are to be viewed;

DETAILED DESCRIPTION OF THE ILLUSTRATED EMBODIMENT

Figure 5:
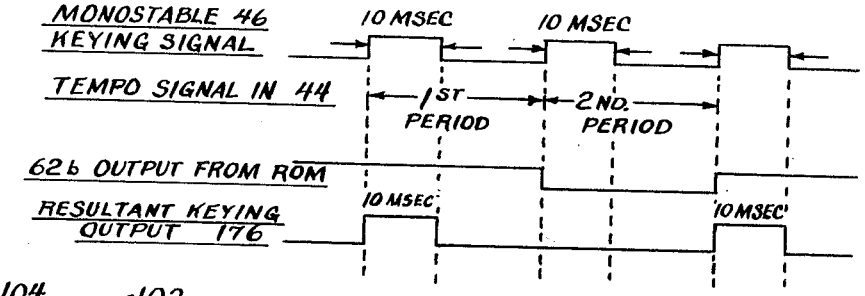
FIG. 5 is a waveform diagram illustrating the operation of a portion of the system of this invention.

To facilitate the description, reference will be had initially to an arpeggio system, it being understood that the principles of the Invention are equally applicable to other accompaniment effects, such as a bass pattern system.

Before turning in detail to the drawings, it will be instructive to briefly consider an electronic musical instrument in which an arpeggio system according to this invention may be advantageously utilized. An electronic musical instrument such as an electronic organ generally includes an upper manual and a lower manual each of which comprise a conventional keyboard. Automatic chord selection is provided by a group of keys or buttons each arranged in conventional fashion for selecting one of a predetermined plurality of chords. In the illustrated embodiment, such a chord selection is accomplished by activation of one of a plurality of keys of the lower manual, each of which bears designation corresponding to the chord selected thereby. Also, a plurality of manually operated switches such as conventional stop-tabs are included, each stop-tab being arranged for selecting one of a plurality of predetermined rhythm patterns for accompaniment of the music to be played. These rhythm stop-tabs may be designated, for example as waltz, latin, rock, march, jazz or other desired rhythm patterns. Also in accordance with conventional practice, a tempo control is provided for adjusting the tempo or rate of the rhythm pattern selected.

Advantageously, the arpeggio system of this invention is responsive to selection of a chord and to selection of a rhythm pattern and tempo, to produce an arpeggio effect comprising notes in tune with the selected chord played in a preselected pattern which is in agreement with the selected rhythm pattern, and at the selected tempo. In accordance with the illustrated embodiment, if the arpeggio system is activated when no rhythm pattern has been selected by the rhythm stop-tabs, an additional predetermined arpeggio pattern is produced. The arpeggio system also includes its own voicing and keying circuits, such that the keying and choice of the output pattern of notes are produced separately of the other organ voices, and is therefore capable of adjustment in volume and in note attack and decay patterns to complement the music and accompaniment with which the arpeggio effect is being provided.

Turning now in detail to the drawings, and initially to FIG. 1, chord select keys designated generally 10 form an input 12 to a keyboard decoder 14 of the arpeggio system of this invention. The keyboard decoder 14 has a group of outputs 16, and is adapted to produce on these outputs a binary code representative of the chord selected by the chord select keys 10 at the input 12. Two of the output lines 16 are also fed to a key down decision circuit 18 which also receives inputs 20 and 22 comprising an on/off switch and clear switch, respectively. The on/off switch comprises the on/off control for the arpeggio system, while activation of the clear switch causes the key down decision circuit 18 to reset the system to discontinue the production of the selected arpeggio effect so as to be ready to produce a subsequently selected arpeggio effect.

Rhythm selection inputs designated generally 24 feed signals from the rhythm pattern selection keys or stop-tabs to a rhythm priority decoder 26 which also receives inputs from a special pattern selector switch 28 and from a rhythm-on control circuit 30. The rhythm-on control circuit 30 receives a rhythm-on control signal 34, a bass riff input **24*d*, and a signal from the key down decision circuit 18 via a line 19, and produces signals on output lines 36 and 38 in response thereto for signalling the rhythm priority decoder 26 and for resetting the system to respond to selection of a rhythm pattern, respectively. The rhythm priority decoder 26 produces control output signals on lines designated generally 40 to a read only memory (ROM) 42 to select from among groups of note position signals stored therein. Each group corresponds to a rhythm pattern selected by the switches 24 and 28. A tempo input 44 carrying a tempo signal from the electronic musical instrument is fed to a tempo gating circuit 46 and by a line 47 to a divide-by-48 circuit 48 which is connected over a plurality of lines 50 for scanning the ROM 42 at a rate corresponding to the tempo signal from the electronic musical instrument. This results in a line by line scan of the lines forming the note position signals in the ROM group selected by the inputs 40. In the illustrated embodiment, each rhythm pattern contains 48 counts, the ROM 42 being scanned or sequenced through a like number of memory locations or lines for each selected rhythm pattern. The counter 48 is reset when the rhythm-on signal 34 or bass riff input 24*d* is activated, or when a chord selection switch 10 is released and cleared (but not when an additional rhythm selector switch 24, 28 is activated.) The key down decision circuit 18 also responds to activation of a chord selection key 10 by presenting an enter signal over a line 52 to a five bit buffer 54 to enter and hold the chord selection code or information on the lines 16, so as to reproduce this information on its output lines, designated generally 56 and MINOR, after the chord select key 10 is released and until a new chord select 10 is activated. Thus, as long as a chord select key is depressed, the corresponding output signals will be produced over the lines 56**, unaffected by subsequent chord select key activation, until all activated keys are released and a new key is activated.

The ROM 42 delivers each note position line of the selected rhythm group over the output lines designated generally 58 to a MOD-12 adder circuit 60, in sequence with the scanning action of the counter circuit 48. At the same time, the chord selection code or information on the lines 56 is fed to another set of inputs of the MOD-12 adder 60. Two of the output lines 58 together with an output line **62*b* of the ROM 42 are fed to a special decoder circuit 64. A remaining one of the output lines of the buffer 54 is labeled MINOR and is fed to a major add circuit 66 which is also fed from a remaining ROM output line 62*a*, and feeds the MOD-12 adder 60 over a line 69. The major add circuit 66 is adapted to produce a suitable signal input to the MOD-12 adder circuit 60 to indicate the selection of a major chord from the chord select keys 10 as detected at the keyboard decoder 14. The ROM outputs 58 and the buffer outputs 56 are combined in the MOD-12 adder to produce output signals on lines 70 to a one-of-twelve decoder 72, and output signals on lines 74 to an octave selector circuit 76. The one-of-twelve decoder 72 receives a group of inputs designated 78 comprising the twelve master or base frequencies of the instrument, corresponding to the twelve tones of the chromatic scale. The one-of-twelve decoder 72 then selects the proper note in accordance with the information provided on the line 70 and delivers the selected note to the octave selector 76 over a line 80. The octave selector 76 generates octavely related tones of the note selected and selects one of these tones in accordance with the signals received over the lines 74. The special decode circuit 64 decodes the information received over the lines 58 and 62*b* from the ROM 42 which corresponds to information stored in the ROM and from the special pattern selector, 28, and the key down decision circuit on line 19*a*, to either allow or inhibit the production of a note at each count in the forty eight count rhythm cycle and to choose the decay characteristic to be produced for each note in the pattern. This information is decoded in the special decode circuit 64 and fed to a keying circuit 82 over a pair of lines 84 and 86. The keying circuit 82 also receives tempo information from the tempo gating circuit 46 over a line 88. A voicing circuit 90 receives the signals from the octave selector 76 and the keying circuit 82 over lines 92 and 94 respectively, and produces signals corresponding to the selected note, if not inhibited, having the selected decay characteristic over an output line 96**, for energizing the output audio circuits of the organ to sound the corresponding notes.

Figure 2A:
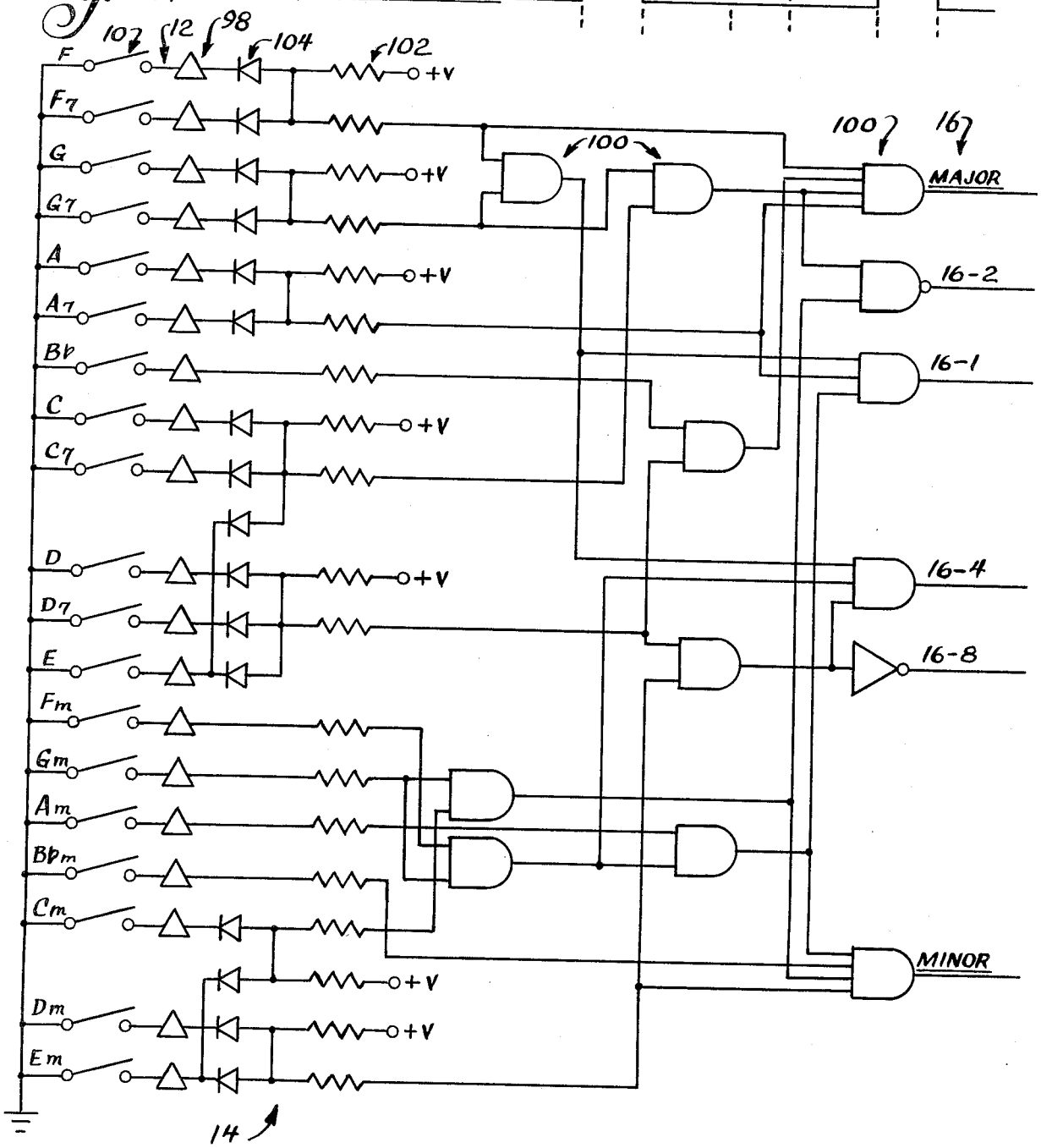
FIGS. 2A through 2E, taken together, comprise a schematic circuit diagram of the arpeggio system of FIG. 1.
Figure 2B:
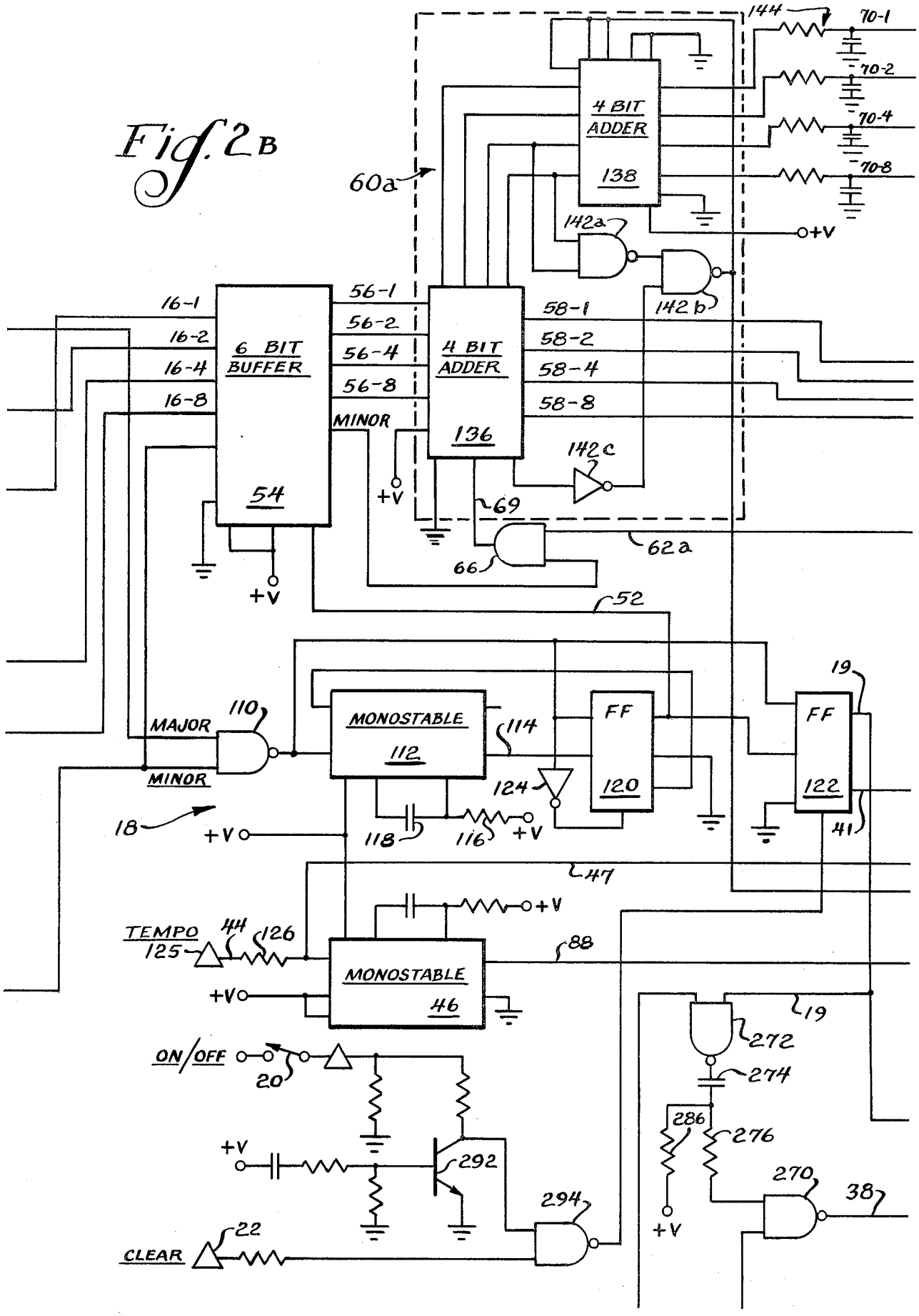
Figure 2C:
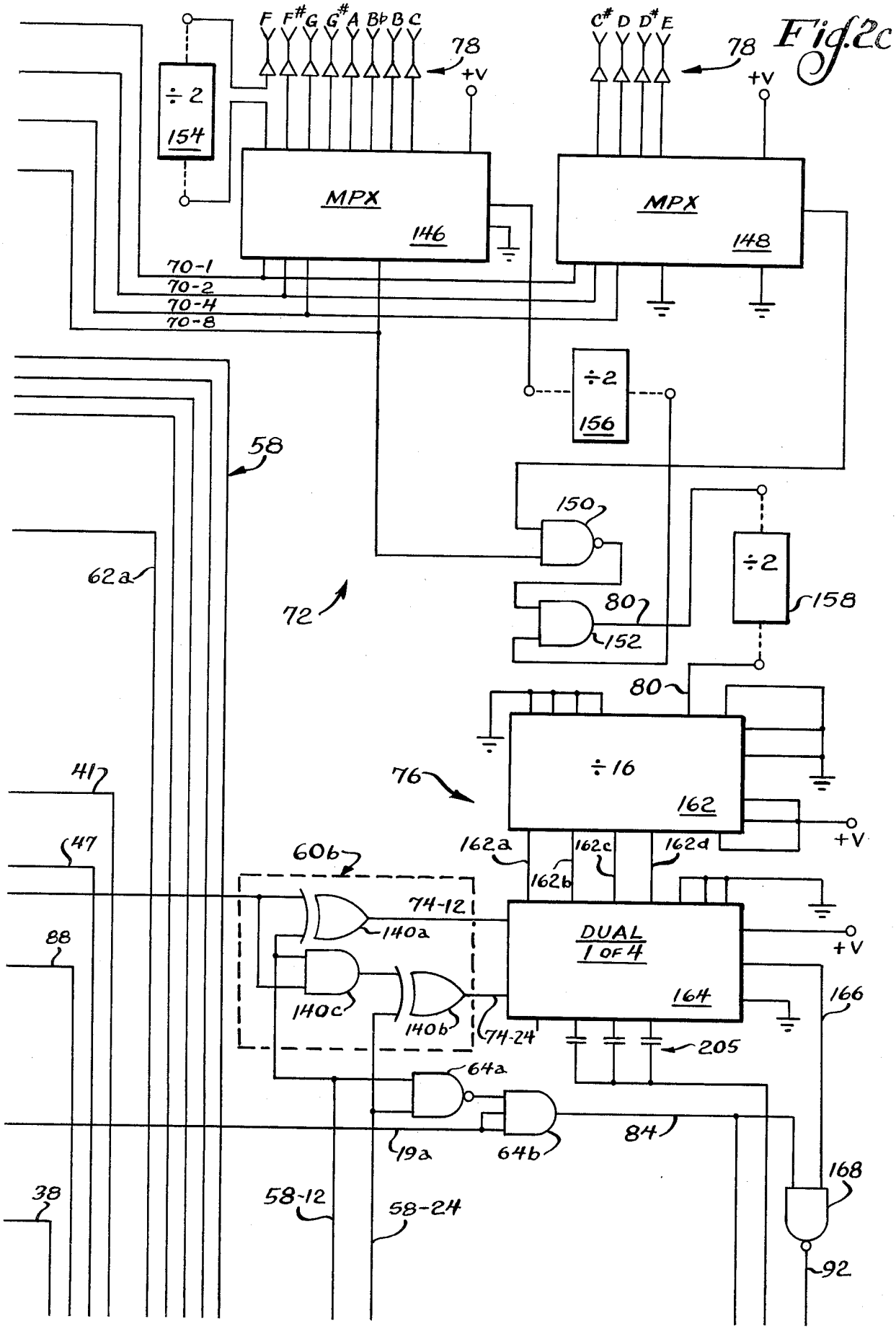
Figure 2D:
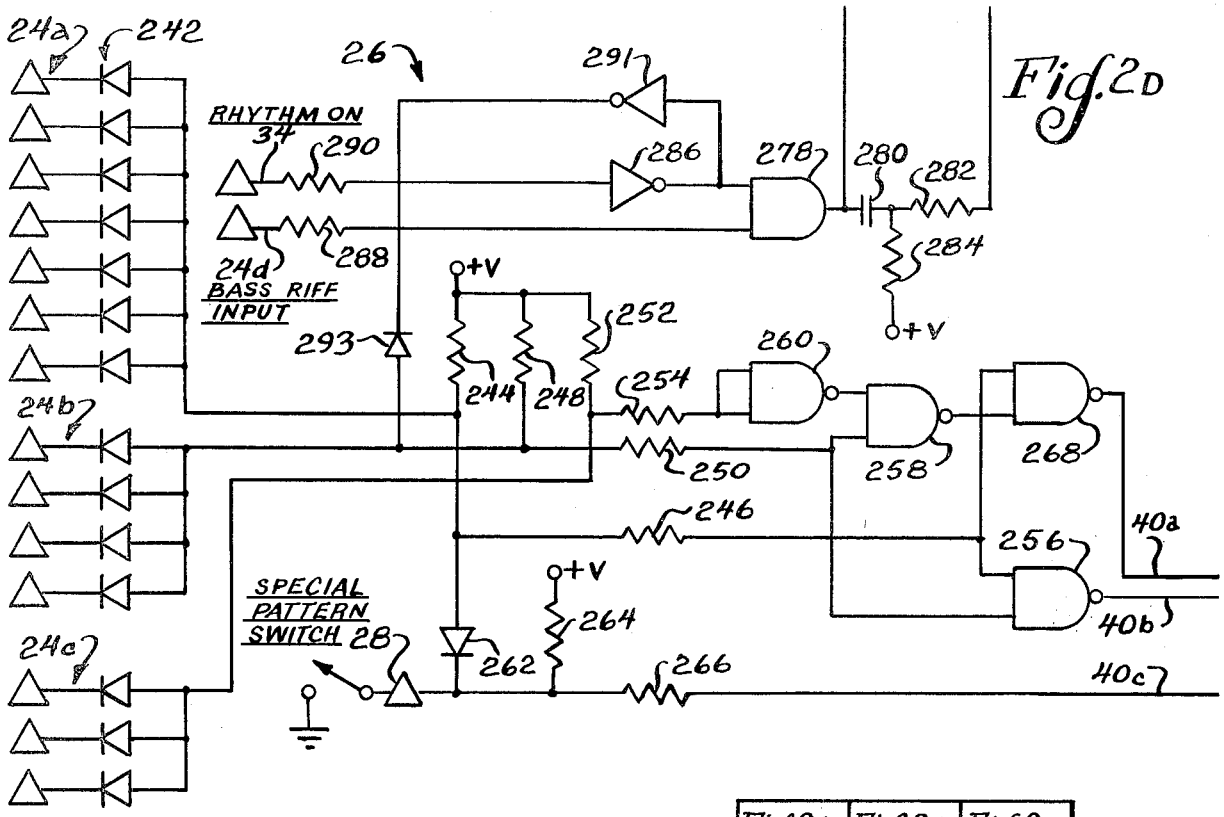
Figure 3:
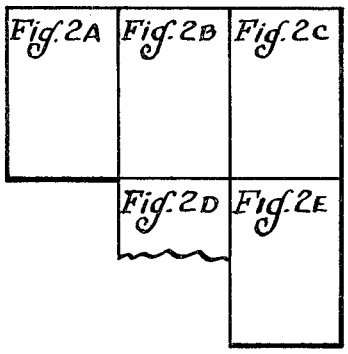

Referring now to FIGS. 2A through 2E, it will be noted that the lines extending to the margins of each figure from continuations of corresponding lines at the margin of the other figures, to produce a single circuit diagram when the figures are arranged as illustrated in FIG. 3.

Referring initially to FIG. 2A, in the illustrated embodiment, the chord select switches 10 comprise nineteen switches, each switch electrically connected for making or breaking a circuit between ground and a corresponding one of the input lines 12. Each of the input lines 12 is fed via a suitable connector, designated generally 98, to a corresponding input terminal of the keyboard decoder circuit 14. The decoder circuit 14 includes a network of digital electronic logic gating elements designated generally 100 which have inputs connected with selected ones of the input terminal connectors 98 so as to receive a logic "0" signal upon closure of associated ones of the chord switches 10. Resistors designated generally 102 and diodes designated generally 104 join selected inputs of the gates 100 with the supply voltage and with selected ones of the terminals 98. The remaining ones of the terminals 98 are connected via others of the resistors 102 directly to other selected inputs of the logic gates 100. Each switch 10 when closed places a logic "0" on its respective connecting pin 98. All inputs of the gates 100 are normally at a logic "1" level. The gate inputs joined by diodes 104 to pins 98 are provided with a logic "1" level by the positive voltage supply connected via the resistors 102. Those input pins 98 that do not join diodes 104 have a logic "1" level via pull-up impedances (not shown) in keyer circuits (not shown) also connected to their associated key switches 10. In the illustrated embodiment, the logic gates 100 are arranged to provide binary coded output signals on the lines 16, which comprise four lines 16-1, 16-2, 16-4 and 16-8, the signals comprising a four-bit binary code corresponding to the relative position or displacement of the switch 10 activated. The remaining output lines of the decoder 14 comprise a MAJOR line and a MINOR line, each carrying a logic signal to indicate whether the activated switch comprises a major chord switch or a minor chord switch. This binary displacement code is given by table 1 below.

TABLE 1

| Chord | Binary Displacement Code 16−1, −2, −4, −8 |
|---|---|
| F | 0 0 0 0 |
| G | 0 1 0 0 |
| A | 0 0 1 0 |
| Bb | 1 0 1 0 |
| C | 1 1 1 0 |
| D | 1 0 0 1 |
| E | 1 1 0 1 |

In the illustrated embodiment, the chord switches 10 are arranged in the order to the corresponding chords F. F7, G, etc. as indicated in FIG. 2A and in table 1. However, the arrangement of the chord switches and the corresponding displacement codes produced by the gating network 100 are for purposes of illustrating a specific embodiment. In accordance with the invention, therefore, any suitable gating network may be utilized to produce a binary code indicative of the relative displacement of a selected chord switch from a given base or zero chord designation. As will be seen later, the input frequencies from which the arpeggio system selects to produce the output arpeggio effect are arranged in similar F to E order to cooperate with the order of arrangement of the chord switches 10.

The MAJOR and MINOR output lines are fed from outputs of the gating network comprising the gates 100 to produce logic signals in response to the activation of the major and minor key chord switches 10, respectively. In the illustrated embodiment the seventh chord switches are also connected with the gating network comprising the gates 100 to produce a major chord signal on the MAJOR line. However, suitable modifications may readily be made in accordance with the principles of this invention for accommodating the seventh chord switches separately from the major and minor chord switches. Similarly, as will be seen hereinbelow, the number, identity and arrangement of chord switches may be varied without departing from the principles of this invention, the read only memory (ROM) 42 as well as the circuits cooperating therewith being readily varied or enlarged accordingly to accommodate such changes.

As best seen in FIG. 2B, the chord displacement lines 16-1, -2, -4, and -8 are fed together with the MINOR line to five inputs of a six bit buffer or storage latch which preferably comprises an integrated circuit of the type generally designated 74C 174, electrically connected to function as the five bit buffer 54. The output lines of the buffer 54 are designated 56-1, 56-2, 56-4, 56-8 and MINOR and receive the same information as the respective similarly designated inputs. The MAJOR and MINOR lines are also fed to two inputs of a two input NAND gate 110 which forms an input stage of the key down decision circuit 18. Consequently, the output of the NAND gate 110 goes high in response to activation of any of the chord selection switches 10. This high level signal will fire a monostable circuit 112 to procuce an eight millisecond long pulse at its output line 114. The monostable circuit 112, in the illustrated embodiment, comprises one-half of a dual monostable integrated circuit generally designated as RCA part type 4098 which is provided with a suitable positive supply voltage via a resistor 116 and capacitor 118 chosen to provide the eight millisecond timing for the output pulse at the line 114. The output signal from the NAND gate 110 is also fed to a pair of "D" type flip-flops 120 and 122 which may be in the form of a dual- D flip-flop IC generally designated 4013. The flip-flop 120 is designated the strobe flip-flop and is interconnected with the monostable 112 and with an inverter 124 so as to set if the chord key 10 is still activated at the end of the eight millisecond period of the pulse on the monostable output line 114, providing an output pulse on the line 52 to cause the buffer 54 to enter the displacement code. Thus, an eight millisecond time delay is provided upon actuation of a chord select key 10 to aid in preventing actuation of the circuits in response to noise or key bounce. The flip-flop 122 is similarly connected with the flip-flop 120 and the NAND gate 110, to set at the same time as the flip-flop 120, thus enabling the ROM 42 via the line 41. It will be appreciated that the described monostable 112 and flip-flop 120 function so that as long as the first actuated chord switch 10 which causes the strobe flip-flop 120 to set remains down, actuation of other chord switches 10 will not affect the system. Only when all activated switches 10 are released will the system respond to a subsequent switch activation.

The tempo input 44 is connected at a suitable connector 125 to receive tempo pulses at the rate selected from the electronic musical instrument. These tempo pulses are delivered via a resistor 126 and the line 47 to the divide-by-48 counter 48 in FIG. 2E. This divide-by-48 counter 48 comprises a divide-by-sixteen counter 128 and a pair of flip-flops 130 and 132 connected as a divide-by-three. An inverter 134 is provided between the output of the divide-by-sixteen counter 128 and the inputs of the flip-flops 130 and 132 to provide proper edge phasing and to form the complete divide-by-48 counter. The divide-by-48 counter 48 counts the tempo pulses to establish at its output lines 50 a binary coded signal corresponding to the 48 count cycle of the rhythm pattern generators of the electronic musical instrument. As the tempo input 44 receives the same tempo pulse used to provide the tempo or rate of the rhythm pattern generator of the electronic musical instrument, the 48 count cycle produced on the output lines 50 is synchronous with the rhythm accompaniment produced by the electronic musical instrument. The lines 50 are fed directly to the select inputs ROM 42 to form the six least significant digits of the select input code. The three most significant digits of the select input code to the ROM 42, come from the rhythm priority decoder circuits 26 as will be described below.

In the illustrated embodiment, the ROM 42 comprises 4096 bits, arranged 512 by 8, static ROM of the type designated MM5232. In accordance with the principles of this invention, however, other suitable ROM devices may be readily utilized. This 512 by 8 bit ROM 42 is divided into 48 word sections, each section corresponding to the 48 counts of one rhythm pattern. Each word in the 48 word section then corresponds to one possible note position within the pattern, and may contain either binary coded note position information or an inhibit code to prevent any note from being played at that count of the rhythm pattern. The binary output of the ROM 42 is then produced over the six output lines designated generally 58 and the two output lines designated **62*a* and 62*b*, in MOD-12 form (Base 12 arithmetic numbering, 1, 2, 3, 4, 5, 6, 7, 8, 9, A, B, C in binary format). The six output lines 58, contain the six least significant digits of the ROM output and are fed to the MOD-12 adder 60 to be combined with the 4 bits of output information on the lines 56 from the six bit buffer 54**, which carry the chord displacement information.

Figure 4:
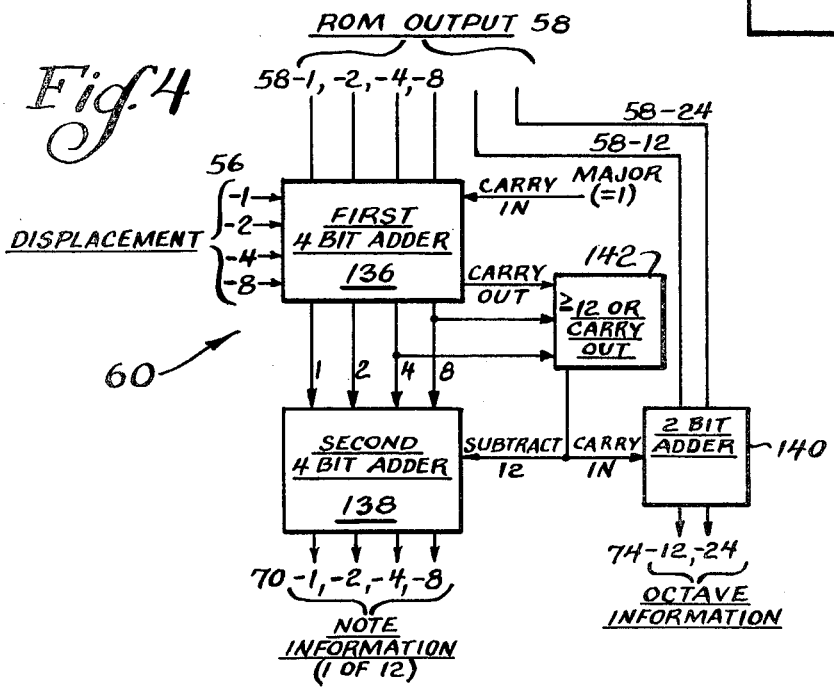
FIG. 4 is a functional block diagram of an adder portion of the system of FIGS. 1 and 2.

Referring now to FIG. 4, a functional block diagram illustrates the operation of the MOD-12 adder, whose components are illustrated in additional detail and designated generally **60*a* and 60*b* in FIGS. 2B and 2C. First and second four bit adders 136 and 138 comprise, in the illustrated embodiment, integrated circuits designated generally 4008. The first four bit adder 136 adds the note position information on the first four binary outputs 58-1, 58-2, 58-4 and 58-8 of the ROM 42 to the chord displacement information on the four binary output lines 56-1, 56-2, 56-4 and 56-8 from the buffer 54, to produce a direct sum on its four binary output lines which form the input to the second four bit adder 138. If this sum is greater than or equal to 12 or if a carry is produced out of the first adder 136 indicating a sum greater than 16, the second adder 138 will subtract 12 from the first adder sum and carry into a two bit adder 140. A circuit designated 142 in FIG. 4 comprises NAND gates 142A and 142B and inverter 142C of FIG. 2B. These elements function as illustrated by the block 142 of FIG. 4 to signal the second four bit adder 138 to subtract 12 and to carry into the two bit adder 140 as required by the sum reached by the first four bit adder 136. The two bit adder 140 comprises exclusive OR gates 140A and 140B together with AND gate 140C which are designated generally 60*b* in FIG. 2C. If the sum out of the first adder 136 is less than 12, the second adder 138 will reproduce the same sum on its output lines 70. The next two ROM output lines 58-12 and 58-24 are fed to the two bit adder 140 which produces the sum of the carry-in with these fifth and sixth bits from the ROM 42 carried on the lines 58-12 and 58-24. Thus, the MOD-12 adder 60 produces one-of-twelve note information in four-bit binary form on its outputs 70-1, 70-2, 70-4, and 70-8, the remaining two bits on its output lines 74-12 and 74-24 provide octave information. Accordingly, the first six bits of each eight-bit ROM word contain note position information, as a binary coded number indicating the relative position of the next note of the arpeggio with respect to the base note or note used to designate the selected chord (for example, in an F chord the note F). It will be appreciated that in binary form the six bits will readily accommodate 48 possible note selections, thereby spanning four octaves. Consequently, by adding the binary coded chord displacement number to the note position binary number from the ROM, the specific note to be played is output from the MOD-12 adder 60 as six bits of information, the first four bits corresponding to one of the twelve possible notes of the chromatic scale and the last two bits corresponding to the octave at which the note is to be played. Suitable RC noise supression filters designated generally 144 are provided in the output lines 70 of the four bit adder 138**.

Referring once again to FIG. 2C, the output lines 70-1, 70-2, 70-4 and 70-8 of the MOD-12 adder, containing the one-of-twelve note information, are fed to a one-of-twelve decoder 72 which functions as a twelve channel multiplexer. In the illustrated embodiment, the twelve channel multiplexer comprises a pair of eight channel multiplexers 146 and 148 which are of the type designated generally 74C151 and are connected together with a pair of logic gates 150 and 152 to form a one-of-twelve selector circuit. The twelve input lines designated generally 78 to the multiplexer units 146 and 148 are designated by the twelve notes of a chromatic scale between F and E as illustrated in FIG. 2C. These inputs 78 comprise the master or base frequency signals corresponding to these twelve notes from the master frequency generator or oscillator of the electronic musical instrument. Divide-by-two integrated circuits 154, 156 and 158 may be optionally added as shown in dotted line in FIG. 2C both at the inputs 78 to the multiplexers and at the outputs thereof to divide down either the input or output frequencies from the multiplexers 146 and 148, or both, as required to produce suitable note frequencies in a particular application. In applications where the dividers 154, 156 and 158 are not needed, they may be replaced by a wire conductor. Table 2 below shows which one of the twelve frequencies input on the line 78 is selected as the output signal on the line 80 in response to the four bits of information on the lines 70.

TABLE 2

| First 4 Bits, Lines 70, of Note Information | Input 78 Chosen |
|---|---|
| 0000 | F (lowest frequency) |
| 1000 | F# |
| 0100 | G |
| 1100 | G# |
| 0010 | A |
| 1010 | A# |
| 0110 | B |
| 1110 | C |
| 0001 | C# |
| 1001 | D |
| 0101 | D# |
| 1101 | E (highest frequency) |

The selected frequency or note output on the line 80 is fed to the octave selector circuit 76 which comprises a divide-by-sixteen circuit 162 and a dual one-of-four select or multiplexer circuit 164. The divide-by-sixteen circuit 162 which provides at its four output lines 162*a, b, c* and *d* for octavely related frequencies of the input frequency at the line 80. These four octavely related frequencies are fed to one input of the dual one-of-four multiplexer 164. In the illustrated embodiment, the divide-by-sixteen circuit 162 comprises an integrated circuit designated generally 4029 and the dual one-of-four decoder circuit comprises a dual one-of-four analog selector integrated circuit designated generally 4052. The remaining two bits of octave information on the lines 74-12 and 74-24 are fed to select inputs of the one-of-four selector circuit 164, which selects and produces at its output line 166 the input signal from the lines 162*a, b, d,* or *d* whose frequency corresponds to the selected octave. The output line 166 forms one input of a two input NAND gate 168 whose output is fed over the line 92 to the input of the voicing circuits 90.

Figure 2E:
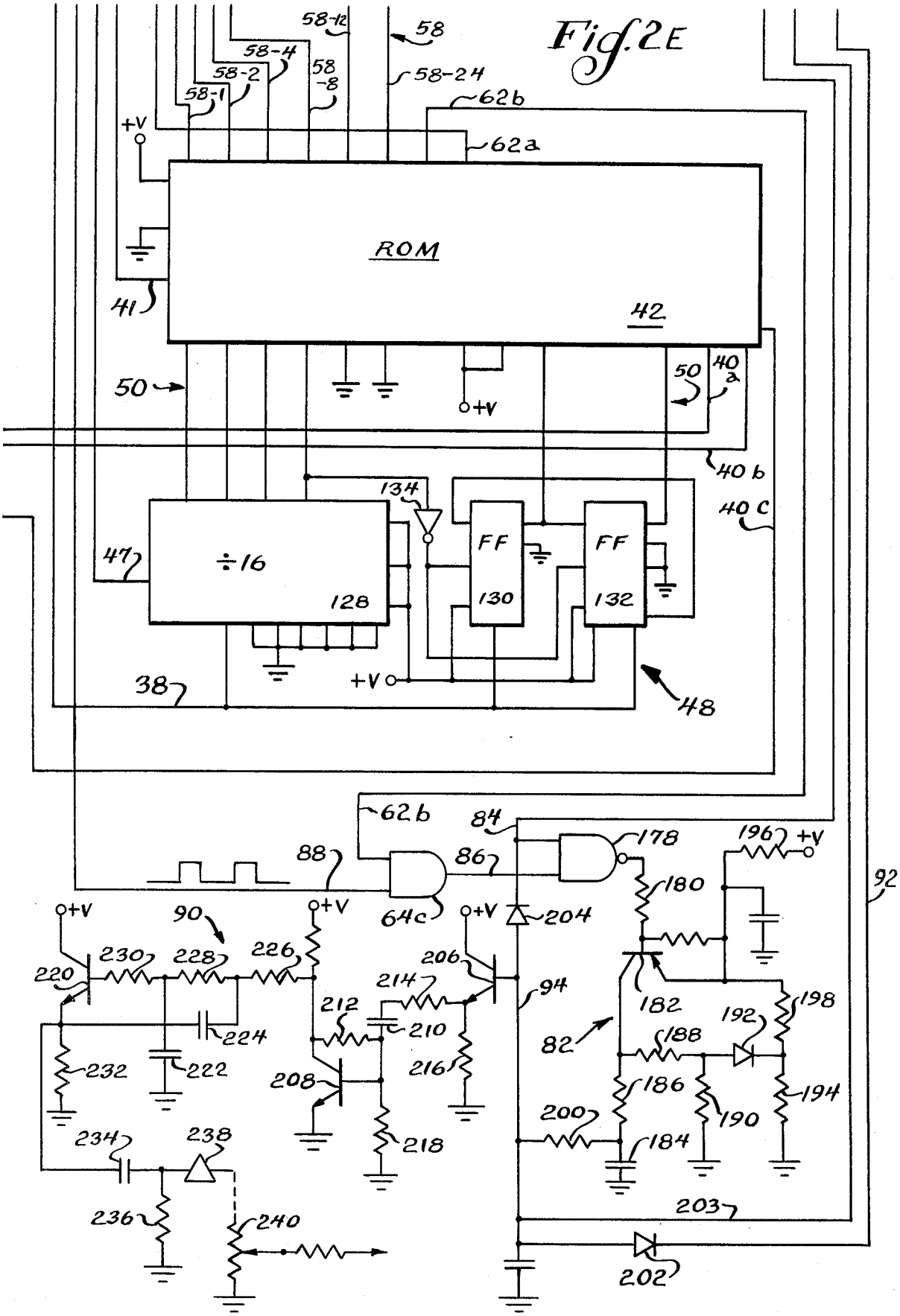

Referring now also to FIG. 2E, the highest four bits of the ROM output (58-12, 58-24, 62*a* and 62*b*) are also utilized to provide system mode information. Table 3 summarizes this information, which will be more fully explained below.

TABLE 3

| ROM 42 OUTPUT | FUNCTION |
|---|---|
| 58–12 and 58–24 both at logic "1" | inhibit note |
| 62a at logic "1" | pulse the keyer |
| 62b at logic "1" | add 1 to note position information if major chord selected |

The special decode circuit 64 comprises a NAND gate 64*a*, and two AND gates 64*b* and 64*c*, in FIGS. 2C and 2E. Lines 58-12 and 58-24 form two inputs to the NAND gate 64*a*. The output of the NAND gate 64*a* forms one input of a three input AND gate 64*b* whose other two inputs are connected by the line 19*a* to the play flip-flop 122 in FIG. 2B. Thus, an inhibit signal comprising a logic "1" on both of the lines 58-12 and 58-24 will produce a logic "0" on the output line 84 of the AND gate 64*b* which line forms the remaining input of the NAND gate 168. Thus, the selected note output on the line 166 will be inhibited thereby. The provision of the AND gate 64*b* assures that an inhibit signal will also be produced to prevent any false signals from being keyed when the arpeggio circuit is turned off.

Accordingly, it will be appreciated that the two bits of output from the ROM 42 on the lines 58-12 and 58-24 serve a dual function in the illustrated embodiment. Specifically, when the line of ROM information currently appearing at its outputs comprises a note which is to be played in the corresponding count of rhythm pattern, the lines 58-12 and 58-24 contain the corresponding note position information to cause selection of the proper note. However, when the line of ROM currently being fed to the output corresponds to a count in the selected rhythm pattern in which the note is to be turned off, the lines 58-12 and 58-24 are programmed instead with logic "1" to present an inhibit frequency signal at the NAND gate 168, thus preventing any note from being sounded at that count of the cycle.

The operation of the keying circuit 82 and the voicing circuit 90 will now be described with reference to FIG. 2E and to the waveform diagram of FIG. 5. Referring first to FIG. 2E, the keying circuit 82 includes a two input NAND gate 178 having its first input fed from the output line 86 of the two input AND gate 64*c*. The AND gate 64*c* receives one input from the ROM output line 62*b* and its opposite input fed from the output line 88 of the monostable 46 which carries a train of 10 millisecond pulses produced in response to the tempo signals at the input 44. The opposite input of the NAND gate 178 receives the allow or inhibit signal produced on the output line 84 of the AND gate 64*b* of FIG. 2C in response to the signals on the output lines 58-12 and 58-24 of the ROM 42. The output signal of the NAND gate 178 is produced in accordance with the waveform diagram of FIG. 5. The top waveform represents the train of ten millisecond output pulses of the monostable 46. The tempo signal at input 44 is seen immediately below to have longer periods than the ten millisecond monostable output pulse. The output of the AND gate 64*c* then follows the monostable 46 keying signal as long as the ROM 42 output 62*b* is high, but stays low when the ROM output 62*b* is low, as seen in the last two lines of the diagram of FIG. 5. Accordingly, the NAND gate 178 will produce an output which inverts and follows the output of the AND gate 64*c* unless the inhibit signal from the ROM lines 58-12 and 58-24 is present at its opposite input. The output signal from the NAND gate 178 then drives the remainder of the keying circuit 82 to produce the attack and decay segments of a keying voltage to be applied at the input line 94 of the voicing circuit 90 together with the selected note frequency output signal from the line 92.

Specifically, the output of the NAND gate 178 is delivered via a resistor 180 to the base electrode of a PNP transistor 182. It will be appreciated then, that when the output **62*b* of the ROM 42 is low, no keying pulse will be applied to the base of the transistor 182 whereas if the output 62*b* is high, a pulse will be applied thereat. In both cases this is true only if the associated signal is allowed (not inhibited) at the gate 178 by the signal at the line 84. Thus, transistor 182 will turn on for a corresponding period and charge a capacitor 184 via a resistor 186. At the end of the input pulse from the NAND gate 178, the transistor 182 will again turn off and the capacitor 184 will begin to discharge back through resistor 186 and through a resistor 188 to one of two discharge paths. The first discharge path is provided by a resistor 190 to ground while the second path is provided through a diode 192 and a resistor 194 to ground. A biasing voltage is also provided from a suitable supply and via a resistor 196 and a resistor 198 to the cathode of the diode 192, such that when the voltage from the discharging capacitor 194 at the anode of the diode 192 reaches the biasing voltage at the cathode, the diode will become back biased and turn off. The capacitor 184 will then discharge only through resistor 190 at a considerably slower rate until the voltage reaches zero, or until the next keying pulse is applied from the NAND gate 178. The voltage at the capacitor 184 is also applied via a resistor 200 to the line 94 at the input of the voicing circuit 90 to provide a keying envelope for the note or frequency signal on the line 92 which is applied to the line 94 via a diode 202. The diode 202 has its cathode connected to the line 92 and its anode connected to the line 94 to effect the application of the keying envelope to the frequency signal to produce at the input of the voicing circuit 90 a signal of the desired frequency and having the desired attack and decay characteristics. A line 203 is also connected to the line 94 and to three capacitors designated generally 205. The capacitors 205 are fed to three inputs of the second one-of-four selector circuit in the the circuit 164 of FIG. 2C. One or none of these capacitors 205 is then selected as an output by the selection of inputs 162 to provide waveshaping of the signal at the line 94, as required for the note selected. A diode 204 has its anode connected to the line 94 and its cathode connected with the line 84 at the input of the NAND gate 178** to eliminate any noise or key click signal when no note is played.

The line 94 is fed to the base electrode of a transistor 206 which together with a transistor 208, a capacitor 210 and resistors 212, 214, 216 and 218 form an amplifier circuit. The output of the amplifier circuit at the collector electrode of the transistor 208 is fed to a two pole low pass active filter circuit comprising a transistor 220, capacitors 222 and 224 and resistors 226, 228, 230 and 232. In the illustrated embodiment, the components are chosen for a 2KHZ resonance. The active filter has an emitter follower output at the emitter electrode of the transistor 220. A capacitor 234 is in series with the emitter electrode of the transistor 220 and a resistor 236 is joined between the capacitor 234 and ground, the junction of the resistor 236 and capacitor 234 feeding the audio output terminal 238 of the arpeggio system. A volume control potentiometer 240 may be added at the output 238 to control the volume of the output audio signal, as indicated in dotted line.

As mentioned previously, the inputs 40 to the ROM 42 present selection information thereto for selecting one of the rhythm pattern sections stored therein in response to selection of a rhythm pattern at the rhythm inputs 24 or 28. Referring to FIGS. 2D and 2E, it will be seen that the inputs 40 comprise three inputs designated **40*a*, 40*b*, and 40*c*, from the rhythm priority decoder circuit designated generally 26 of FIG. 2D. The rhythm input lines include lines arranged in groups designated 24*a*, 24*b*, 24*c*, 24*d* and the special pattern input 28. The inputs 24*a* through 24*d* are fed from rhythm selection stop tabs of the electronic musical instrument. Each of the inputs in the groups 24*a*, 24*b*, and 24*c* are fed to the cathode of one of a group of diodes designated generally 242. The anodes of the diodes 242 associated with the inputs the 24*a* are connected in common with the junction of a pair of resistors 244 and 246. Similarly, the anodes of the diodes associated with the inputs 24*b* and 24*c* are respectively connected in common to the respective junctions of resistors 248 and 250 and of resistors 252 and 254. The opposite ends of resistors 244, 248 and 252 are fed from the positive voltage supply. The opposite input of resistor 254 feeds both inputs of a two input NAND gate 260. The opposite end of resistor 246, is fed to one input of each of a pair of two input NAND gates 256 and 268. Similarly, the opposite end of resistor 250 is fed to one input of each of a pair of two input NAND gates 256 and 258. The special pattern input terminal 28 is connected with a switch selectively actuatable for either open circuiting or grounding the terminal 28. The terminal 28 is also connected with the cathode of a diode 262 whose anode is connected with the junction of the resistors 244 and 246. The terminal 28 is further connected with the junction of a pair of resistors 264 and 266, the resistor 264 being fed from the positive voltage supply and and the resistor 266 feeding the output line 40*c*. Similarly, the output line 40*b* is fed from the output of the NAND gate 256 whose inputs are fed from the resistors 246 and 250 respectively. The output line 40*a* is fed from the output of the input NAND gate 268 whose inputs are fed from the output of the NAND gate 258 and from the resistor 246, respectively. Thus, the priority gating system 26 is established via the gates 256, 258, 260 and 268 for the rhythm inputs of the groups 24*a*, 24*b* and 24*c*. The aforementioned sections of the ROM 42 each are programmed with a pattern compatible with one of the groups of rhythm patterns arranged at the rhythm inputs 24*a*, 24*b* and 24*c*. It will be appreciated that additional rhythm patterns may be accommodated by either providing additional diodes such as the diodes 242 at the existing inputs 24 or by utilizing a larger ROM 42 and varying the priority circuit 26** accordingly.

The arpeggio circuit may be reset to accept a new rhythm pattern selection by resetting the divide-by-48 counter 48 of FIG. 2E. This is accomplished by circuits illustrated in FIGS. 2B and 2D. It will be seen that the reset line 38 from the divide-by-48 counter 48 is fed from the output of a two input NAND gate 270 of FIG. 2B. One input of the NAND gate 270 is fed from the output of a two input NAND gate 272 via the series combination of a capacitor 274 and a resistor 276, the other input is fed from the output of a two input AND gate 278 via the series combination of a capacitor 280 and a resistor 282. The positive voltage supply is fed via resistors 284 and 286, respectively, to the junction of the capacitor 280 with the resistor 282 and to the junction of the capacitor 274 with the resistor 276. The NAND gate 272 has one input fed from the output line 19 of the play flip-flop 122 and its opposite input fed from the output of the AND gate 278. The AND gate 278 has its two inputs fed from an inverter 286 and from a resistor 288. The inverter 286 is fed from the "rhythm on" input 34 via a resistor 290, while the resistor 288 is fed from the rhythm pattern input 24*d*. Thus, initial actuation of the rhythm on signal or actuation of the rhythm pattern selector at the input 24*d* will reset the divide-by-48 counter. The divide-by-48 counter will also be reset via the play flip-flop 122 (and only when it is activated) in the absence of actuation of the foregoing switches, when a chord select switch 10 is activated. As seen in FIG. 2B, the play flip-flop 122 will also be reset by either actuation of the on/off switch 20 (to the off state) or the clear control 22 via a circuit including a transistor 292 and a NAND gate 294 as seen in FIG. 2B. An inverter 291 feeds the output of the inverter 286 to the cathode of a diode 293, whose anode is connected to the junction of the resistors 248 and 250. This provides selection of the 24*b* pattern when there is no "rhythm on" signal at the input 34.

In the illustrated embodiment, the last bit of output information from the ROM 42, on the line 62*a*, is fed to the major add circuit 66, which is seen in FIG. 2B to comprise a two input AND gate. The line 62*a* feeds one input of the AND gate 66 whose opposite input is fed by the MINOR output line of the buffer 54. The output line 69 of the AND gate 66 feeds the carry-in input of the first four-bit adder 136, to provide an additional count at the output thereof, when a major chord is selected by one of the switches 10. Provision of major chord tone selection in this fashion provides some measure of economy in the utilization of ROM 42 capacity. Specifically, in the illustrated embodiment, when a minor chord is selected, the signal on the MINOR output line of the buffer 54 will inhibit the additional count signal from the line 62*a* at the AND gate 66. However, when a major chord switch 10 is activated, the MINOR line will allow the signal at the AND gate 66, from the line 62*a*, producing a corresponding output signal at the line 69 for adding one count to the four-bit adder 136. The ROM 42 is programmed accordingly to contain note position information corresponding to flatted thirds on each line thereof that contains information calling for a third tone of a chord. However, the bit in this line corresponding to that output line 62*a* will contain a signal for adding one count to this note position, which will be added as described via the AND gate 66 when major chord is selected. This added count at the output of the MOD-12 adder 60, causes the selection by the multiplexers 146 and 148 of the proper third tone of the major chord selected.

Figure 6:
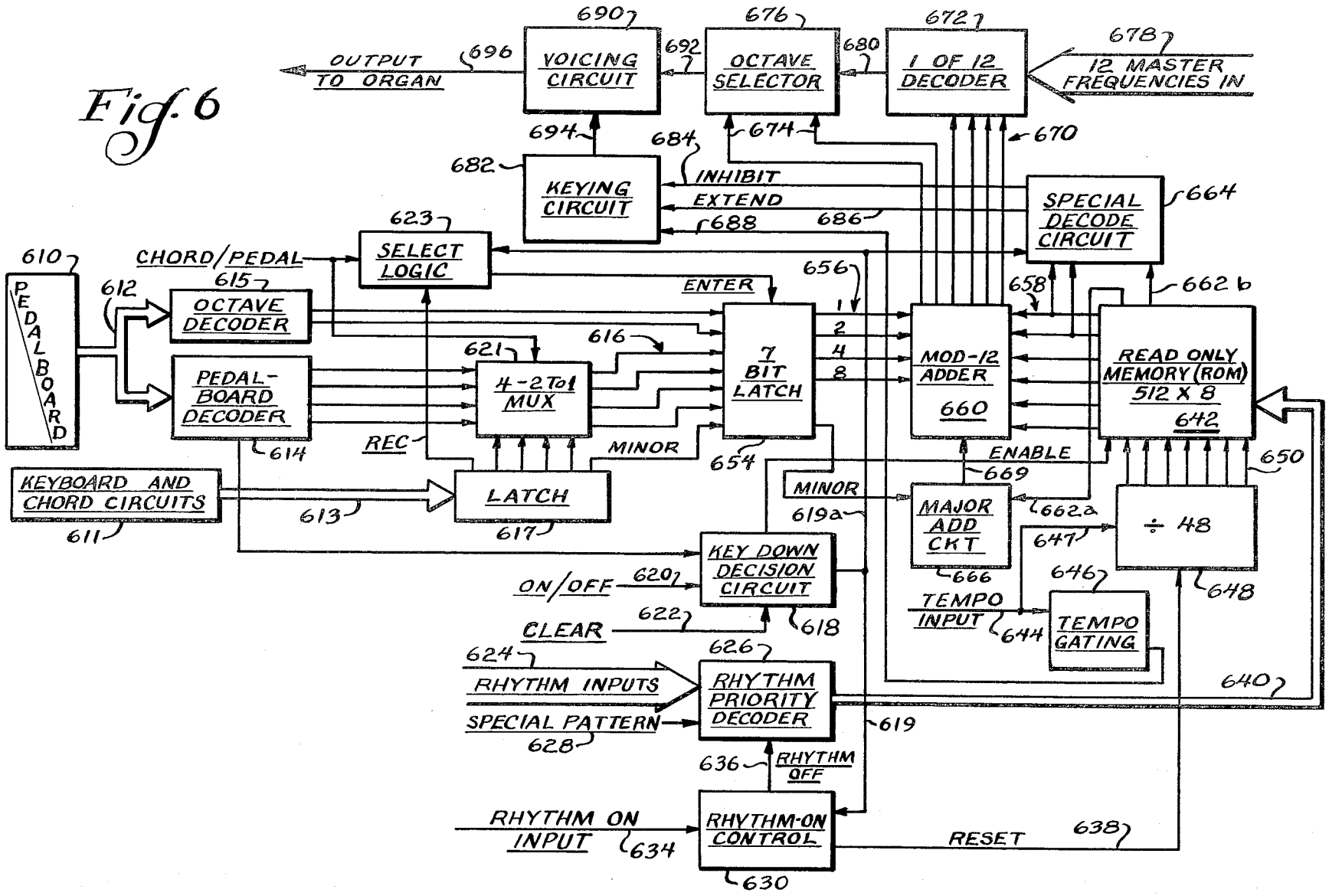
FIG. 6 is a block diagram, similar to FIG. 1 of an accompaniment system according to this invention, embodied as a bass pattern system.

Referring now to FIG. 6, a bass pattern system, similar to the arpeggio system of FIG. 1, is illustrated in block diagrammatic form. In this embodiment, the electronic musical instrument, such as an organ, includes a pedal board 610 which comprises one or more octaves of foot-operated pedal switches. The pedal switches are selectively actuable by the player of the organ to select bass notes. Output lines, designated generally 612, of the pedal board 610 are fed to a pedal board decoder 614 and an octave decoder 615. These decoders 614 and 615 producing encoded signals, corresponding to the note actuated on the pedal board and the octave of the note actuated, where the pedal board 610 includes more than one octave of notes. The function of the pedal board decoder 614 and octave decoder 615 is substantially similar to the keyboard decoder 14 of FIG. 1. Four outputs of the pedal board decoder 614 are fed to one set of inputs of four two-to-one multiplexers 621. A second set of inputs of the multiplexers 621 are fed from a latch 617. The latch 617 receives input signal information, over lines designated generally 613, from one of the other keyboards of the instrument and an associated chord circuit designated generally 611. A CHORD/PEDAL select tab directs the multiplexer 621 to select either the pedal board decoder 614 output or the latch 617 output to feed to its output lines 616. The output lines 616 are fed to seven bit latch 654 which is substantially similar to the five bit buffer 54 of FIG. 1. Other inputs to the seven bit latch 654 include two bits of octave information from the octave decoder 616 and a minor select line from the latch 617, which is substantially similar to the minor select input to the five bit buffer 54 of FIG. 1. An additional control line designated REC is fed from the latch 617 to a select logic circuit 623 which also is fed from the CHORD/PEDAL tab. An ENTER signal to the seven bit latch 654 is generated by the select logic in response to the signals at its two inputs.

The remaining elements of FIG. 6 are indicated by reference numerals similar to the reference numerals of FIG. 1, but prefaced by a six (6). These elements are substantially similar in function and structure to the similarly numbered elements of FIG. 1.

Accordingly, it will be seen that the bass pattern system of FIG. 6 is responsive to selection of a note from the pedal board 610 or, alternatively from the other instrument keyboard or keyboards and their associated chord circuits 611, to produce a predetermined bass pattern comprising bass notes in a key determined by the note or chord selected. The ROM 642 is programmed similarly to the ROM 42 of FIG. 1 to produce the proper bass notes at preselected intervals to complement a selected rhythm pattern and in the selected tempo.

Figure 7:
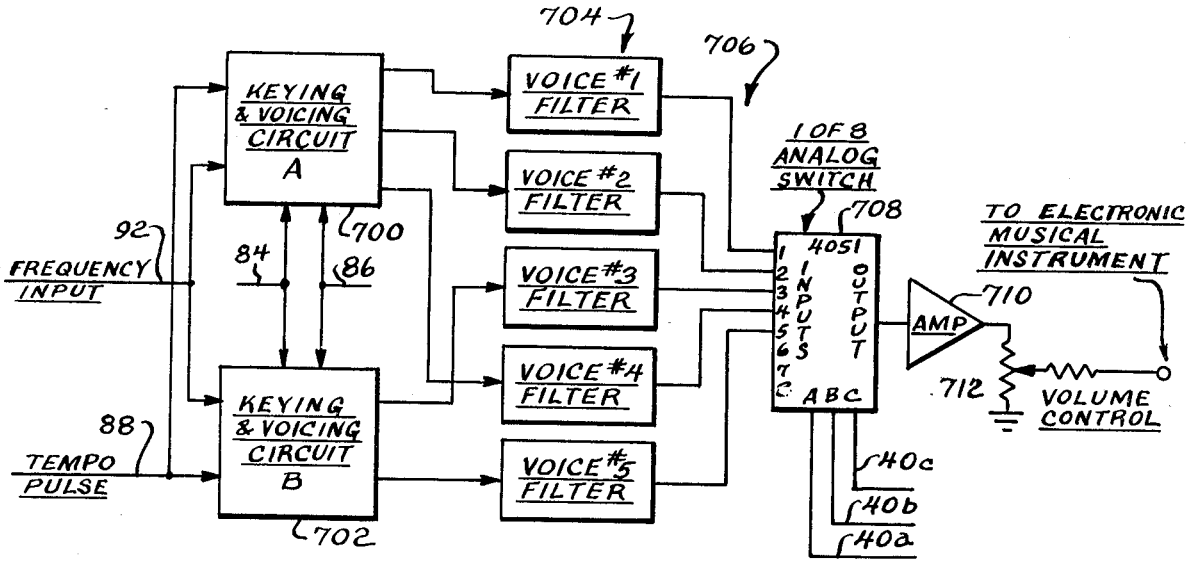
FIG. 7 and FIG. 8 are block diagrams of alternate forms of a portion of the system of either FIG. 1 or FIG. 6.

Referring now to FIG. 7, the illustrated circuit may alternatively be used in place of the keying and voicing circuits 82 or 682 and 90 or 690 of FIG. 1 or FIG. 6. Briefly, one or more keying and voicing circuits, here shown as two such circuits 700 and 702, each receives the respective signals on the lines 84, 86, 88 and 92. These circuits feed one or more voice filters 704, (here shown as five such filters) which then simultaneously produce a plurality of different voices at their respective outputs, which are designated generally by reference numerals 706. A one-of-eight analog switch integrated circuit 708 receives these output lines 706 and selects one of them to be fed to a following analog amplifier 710 and volume control potentiometer 712. The output or wiper arm of the volume control potentiometer 712 then feeds the selected signal at the selected volume or level to the audio reproduction circuits of the electronic musical instrument. The one-of-eight analog switch 708 may comprise an integrated circuit of the type generally designated 4051. The three control lines 40*a*, 40*b*, and 40*c* from the rhythm priority decoder circuit 26 are the same as the like numbered lines fed to the ROM 42 (or 642) for selecting the note position signals therefrom. Accordingly, a suitable voice for the particular rhythm pattern selected on the lines 24 (or 624), is selected at the one-of-eight analog switch 708, simultaneously with the selection of the suitable data from the ROM 42 (or 642). Briefly, the keying and voicing circuits 700 and 702 may comprise circuits substantially similar to the elements illustrated as forming the circuits 82 and 90 of FIG. 2E, with the exception of the filter circuit comprising the transistor 220 and related components, as described above with reference to FIG. 2E. Accordingly, the voice filter circuits 704 are substantially similar to this latter filter circuit, with different values of components substituted to obtain different resonance frequencies and hence different voices.

Figure 8:
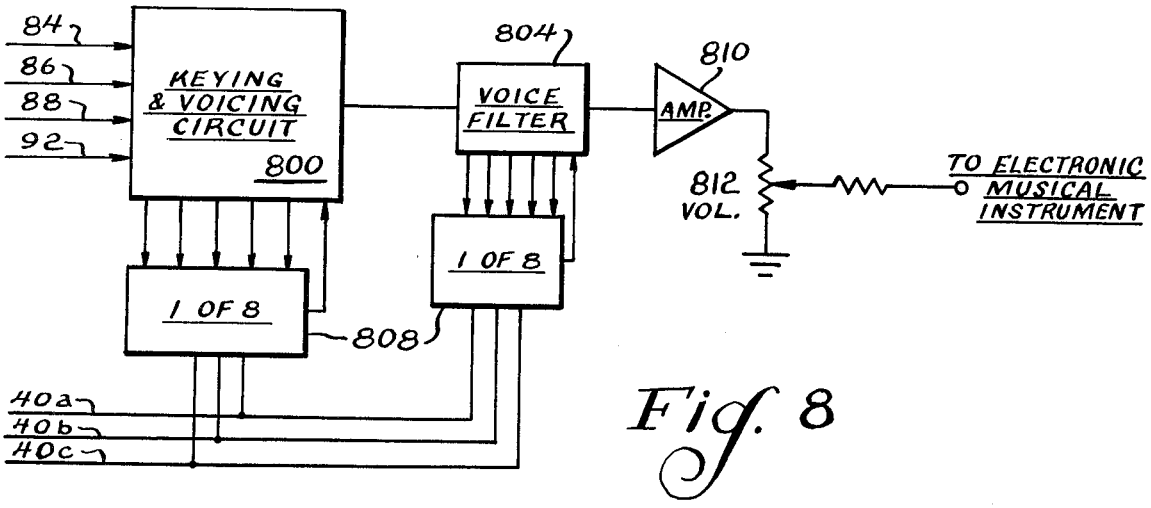

Alternatively, the keying and voicing circuit arrangement may be of the form illustrated in FIG. 8. Here, a single keying and voicing circuit 800 and a single voice filter 804 are utilized, and are substantially similar to the components 700 and 704 described above. In this embodiment, one or more one-of-eight analog switches 808 (here, two are shown) are utilized in conjunction with the respective circuits 800 and 804, for selecting different component values within the respective circuits. The same lines 40*a*, 40*b*, 40*c* control the switches 808 as described above with reference to the switch 708. For example, the one-of-eight analog switch 808 associated with the keying and voicing circuit 800 might be utilized to select the resistor 186 or capacitor 184 illustrated in FIG. 2E from among a plurality of different value resistors or capacitors, to effect a different attack and decay envelope, as described above with reference to FIG. 2E. Similarly, the one-of-eight analog switch 808 associated with the voice filter 804 might select, for example, one or more of the resistors or capacitors 222 through 232 inclusive illustrated in FIG. 2E from among a plurality of different value resistors or capacitors. This would change the resonance frequency of the filter according to which component value is selected, and vary the output voice therefrom accordingly. An amplifier 810 and volume control potentiometer 812 are illustrated connected with the output of the voicing filter 804 and function similarly to the components 710 and 712 of FIG. 7. Accordingly, by the selection from among a plurality of components which may be made available in the keying and voicing circuit 800 and voice filter 804, a plurality of different voices, attack times, decay times, and the like, may be selected via the lines 40*a*, 40*b* and 40*c*, simultaneously with the selection of a particular rhythm pattern.

While the present invention has been described with reference to a preferred embodiment, the invention is not limited thereto. On the contrary, the invention is intended to cover all changes and modifications as might occur to those skilled in the art, the invention being properly defined by the appended claims.

The invention is claimed as follows:

1. In an electronic musical instrument having a plurality of switch means each manually operable for selecting one of a plurality of predetermined cords, an arpeggio system selectively operable for producing arpeggio effects, comprising: first electronic circuit means for producing a predetermined chord position signal in response to operation of each of said switch means, ROM means containing predetermined arithmetically and time related patterns of note position signals, second electronic circuit means for arithmetically adding the chord position signal of the selected chord with each of selected ones of said note position signals to generate arpeggio signals, and third electronic circuit means responsive to said arpeggio signals for directing said musical instrument to sound an arpeggio effect in the musical key of the selected chord.

2. In an electronic musical instrument according to claim 1 and further having means manually operable for selecting one of a plurality of predetermined rhythm patterns, wherein said arpeggio system further includes fourth electronic circuit means responsive to said rhythm pattern selecting means for causing said ROM means to deliver selected ones of said note position signals to said adding means for generating said arpeggio signals in accordance with the selected rhythm pattern.

3. In an electronic musical instrument according to claim 2 and further having selectable rate tempo signal generating means, wherein said ROM means contains said note position signals arranged in a plurality of predetermined groups, the note position signals in each group being arranged at predetermined intervals to correspond to at least one of said plurality of predetermined rhythm patterns, said ROM means being responsive to said fourth circuit means for delivering a selected one of said groups of said note position signals corresponding to the selected rhythm pattern to said adding means, and further including fifth electronic circuit means responsive to said tempo signal for causing said ROM means to deliver the note position signals in the selected group to said adding means at time intervals corresponding to said predetermined intervals, in a predetermined sequence and at the selected rate of the tempo signal.

4. In an electronic musical instrument according to claim 3 further including electronic control circuit means responsive to actuation of a first-actuated one of said chord selection switch means for preventing response of said arpeggio system to actuation of a subsequently actuated chord selection switch means until said first actuated chord selection switch means is released.

5. In an electronic musical instrument according to claim 4, further including arpeggio on/off switch means and clear switch means, said electronic control circuit means being further responsive to actuation of one of said chord selection switch means for activating the arpeggio system to produce said arpeggio effect only in response to actuation of said arpeggio on/off switch means to its on position, and for continuing said production of said arpeggio effect after release of said one of said chord selector switch means until the first occurring of: actuation of a subsequent one of said chord selection switch means, actuation of said clear switch means, or actuation of said on/off switch means to its off position.

6. In an electronic musical instrument according to claim 3 wherein said ROM means further includes an additional group of said note position signals corresponding to a preselected rhythm pattern not comprising one of said manually selectable rhythm patterns, and said fourth electronic circuit means is responsive to actuation of one of said chord selecting switch means for causing said ROM means to deliver the note position signals of said last mentioned group in response to actuation of none of said rhythm pattern selecting means.

7. In an electronic musical instrument according to claim 3 wherein said fourth electronic circuit means comprises a network of digital electronic gating elements interposed between said rhythm pattern selecting means and said ROM means.

8. In an electronic musical instrument according to claim 7 wherein said fifth electronic circuit means comprise a digital electronic counter circuit interposed between said tempo signal generating means and said ROM means.

9. In an electronic musical instrument according to claim 1 wherein said ROM means further contains a note decay signal for each note position signal and corresponding to a preselected decay characteristic, and said third electronic circuit means is further responsive to said decay signal for directing said musical instrument to impart a decay characteristic to each note sounded in said arpeggio effect in accordance with its associated note decay signal.

10. In an electronic musical instrument according to claim 1 wherein said first electronic circuit means comprises a network of digital electronic logic gating elements for producing an electronic digital signal comprising said chord position signal.

11. In an electronic musical instrument according to claim 10 wherein said second electronic circuit means comprises a MOD-12 adder circuit for combining selected ones of said digital electronic chord signals with selected ones of said note position signals to produce said arpeggio signals, each arpeggio signal comprising a first digital signal corresponding to a selected tone of the chromatic scale and a second digital electronic signal corresponding to the octave of the selected tone.

12. In an electronic musical instrument according to claim 11 wherein said third electronic circuit means includes a one-of-twelve selector circuit responsive to said first digital signal for providing the selected tone and a divider circuit for receiving the selected tone from the one-of-twelve selector circuit and producing a plurality of octavely related tones, and a further selector circuit responsive to said second digital signal for delivering a selected one of said octavely related tone signals to said electronic musical instrument.

13. In an electronic musical instrument having chord selection means for selecting one of a plurality of chords and rhythm selection means for selecting one of a plurality of predetermined rhythm patterns, an arpeggio system comprising: electronic circuit means responsive to the operation of said chord selection means for producing a chord identity signal, ROM means responsive to operation of said rhythm selection means for producing a predetermined plurality of note position signals, second electronic circuit means for arithmetically adding said chord identity signal to each of said note position signals for producing accompaniment control signals, and third electronic circuit means responsive to said accompaniment control signals for directing the electronic musical instrument to sound selected notes of the chromatic scale over a predetermined number of octaves, in a predetermined sequence and at predetermined time intervals in accordance with the selected rhythm pattern to produce an arpeggio effect.

14. In an electronic musical instrument having chord selection means operable for selecting one of a plurality of chords and rhythm selection means operable for selecting one of a plurality of a predetermined rhythm patterns, an arpeggio system comprising: ROM means containing a plurality of note position signals arranged in predetermined groups, the note position signals in each group being arranged at predetermined intervals and in a predetermined sequence to correspond to at least one of said rhythm patterns, first electronic circuit means responsive to operation of said rhythm selection means for selecting the note position signals in a corresponding one of said groups of note posisition signals from said ROM, second electronic circuit means responsive to operation of said chord selection means for producing a chord location signal and for arithmetically adding said chord location signal with said selected note position signals in said predetermined sequence and at time intervals corresponding to said predetermined intervals to produce arpeggio signals, and third electronic circuit means responsive to said arpeggio signals for directing said electronic musical instrument to sound the selected notes in said predetermined sequence and at said time intervals to produce an arpeggio effect.

15. In an electronic musical instrument having a plurality of switch means each manually operable for selecting one of a plurality of predetermined notes, an accompaniment system selectively operable for producing accompaniment effects, comprising: first electronic circuit means for producing a predetermined note signal in response to the operation of each of said switch means, ROM means for containing predetermined note position signals, second electronic circuit means for arithmetically adding the note signal of the selected note with selected ones of said note position signals to generate accompaniment signals, and third electronic circuit means responsive to said accompaniment signals for directing said musical instrument to sound an accompaniment effect in a musical key related to the selected note.

16. In an electronic musical instrument having note selection means for selecting one of a plurality of notes, chord selection means for selecting one of a plurality of predetermined chords and rhythm selection means for selecting one of a plurality of predetermined rhythm patterns, an accompaniment system comprising: electronic circuit means selectively responsive to the operation either of said chord selection means or of note selection means for producing first signals corresponding to the identity of the operated selection means, ROM means responsive to said rhythm selection means for producing predetermined second signals corresponding to note positions, means for arithmetically adding said first and second signals to form accompaniment control signals and means responsive to said accompaniment control signals for directing the electronic musical instrument to sound selected notes over a predetermined number of octaves, in a predetermined sequence and at predetermined time intervals in accordance with the selected rhythm pattern to produce an accompaniment effect.

17. In an electronic musical instrument having bass note selection means for selecting one of a plurality of bass notes and rhythm selection means for selecting one of a plurality of rhythm patterns, a bass pattern system comprising: electronic circuit means responsive to the operation of said note selection means for producing first signals corresponding to the identity of the operated bass note selection means, ROM means responsive operation of said rhythm selection means for producing second signals corresponding to predetermined note positions, means for arithmetically adding said first signals and said second signals to form control signals and means responsive to said control signals for directing the electronic musical instrument to sound selected notes of the chromatic scale in a predetermined octave, in a predetermined sequence and at predetermined time intervals in accordance with the selected rhythm pattern, to produce a bass pattern effect.

18. In an electronic musical instrument having a plurality of switch means each manually operable for selecting a note of the chromatic scale, an accompaniment system comprising: ROM means for producing electronic accompaniment signals corresponding to the positions of preselected notes of the chromatic scale in a predetermined number of octaves, at predetermined time intervals and in a predetermined sequence, electronic circuit means responsive to actuation of each of said plurality of switch means for producing a note name signal corresponding to the actuated switch means and for arithmetically adding the note name signal to the accompaniment signals to produce accompaniment control signals and second electronic circuit means responsive to said accompaniment control signals for directing said electronic musical instrument to sound notes of said predetermined note names in said predetermined sequence, over said predetermined number of octaves and at said predetermined time intervals to produce an accompaniment effect.

19. In an electronic musical instrument having note selection means for selecting a note of the chromatic scale and rhythm selection means for selecting one of a plurality of predetermined rhythm patterns, an accompaniment system comprising: ROM means selectively actuatable for producing a plurality of predetermined accompaniment signals corresponding to the relative positions of predetermined notes in the chromatic scale at predetermined time intervals and in a predetermined sequence, and electronic circuit means responsive to the operation of said note selection means for producing note name signals corresponding to the operated note selection means, for actuating said ROM means to produce predetermined ones of said accompaniment signals and for arithmetically combining said note name signal with each of said accompaniment signals to produce accompaniment control signals and further electronic circuit means for directing the electronic musical instrument to sound corresponding notes of the chromatic scale in a predetermined sequence and at predetermined time intervals in response to the produced accompaniment control signals, and in accordance with the selected note and rhythm patterns, to produce an accompaniment effect.

20. In an electronic musical instrument according to claim 19 further including means for providing a plurality of selectable note attack and decay patterns and means for providing a plurality of selectable voices, and means responsive to the operation of said rhythm selection means for selecting a predetermined one of said attack and decay patterns and a predetermined one of said voices for each of said notes to be sounded by the electronic musical instrument, in accordance with the rhythm pattern selected.

21. In an electronic musical instrument having a plurality of switch means each manually operable for selecting one of a plurality of predetermined notes, a pattern generation system comprising: first electronic circuit means for producing a predetermined note name signal in response to the operation of each of said switch means and corresponding to the note selected thereby, ROM means containing a plurality of predetermined note position signals, second electronic circuit means for arithmetically adding the note name signal with each of selected ones of said note position signals to form pattern control signals, and third electronic circuit means responsive to said pattern control signals for directing said musical instrument to sound a note pattern corresponding thereto.

22. In an electronic musical instrument having a plurality of switch means each manually operable for selecting one of a plurality of predetermined chords, a pattern generation system comprising: first electronic circuit means for producing a predetermined note name signal in response to operation of each of said switch means and corresponding to the root tone of the chord selected thereby, ROM means containing a plurality of predetermined note position signals, second electronic circuit means for arithmetically adding the note name signal with each of selected ones of said note position signals to form pattern control signals, and third electronic circuit means responsive to said pattern control signals for directing said musical instrument to sound a note pattern corresponding thereto.

* * * * *